US005182732A

United States Patent [19]

Pichowkin

[11] Patent Number: 5,182,732

[45] Date of Patent: Jan. 26, 1993

[54] REVERSIBLE FISH FINDER APPARATUS

[76] Inventor: Oleg Pichowkin, 1422 Ashland Ave., Evanston, Ill. 60201

[21] Appl. No.: 784,550

[22] Filed: Oct. 29, 1991

[51] Int. Cl.[5] ..... H04R 17/00

[52] U.S. Cl. ..... 367/173; 367/165; 367/104; 367/16

[58] Field of Search ..... 367/16, 88, 104, 165, 367/173, 910; 181/140

[56] References Cited

U.S. PATENT DOCUMENTS

| | | | |
|---|---|---|---|
| 2,825,884 | 3/1958 | Fryklund | 367/173 |
| 3,553,638 | 1/1971 | Sublett | 367/173 |
| 3,752,431 | 8/1973 | McBride | 367/173 |
| 4,152,690 | 5/1979 | Veatch | 367/173 |
| 4,479,206 | 10/1984 | Granberg et al. | 367/104 |
| 4,815,048 | 3/1989 | Boucher et al. | 367/173 |
| 4,888,747 | 12/1989 | Williams | 367/173 |
| 4,928,915 | 3/1990 | Havins | 367/173 |
| 4,979,153 | 12/1990 | Terry | 367/173 |
| 4,980,872 | 12/1990 | Oler et al. | 367/173 |
| 4,982,924 | 1/1991 | Havins | 367/173 |

*Primary Examiner*—J. Woodrow Eldred

*Attorney, Agent, or Firm*—Lockwood, Alex, FitzGibbon & Cummings

[57] ABSTRACT

A reversible drive for a fish-finder apparatus includes a motor, a drive gear driven by the motor, a driven gear driven by the drive gear and a fish-finder drive shaft driven by the driven gear. The drive gear contains one or more actuator members which actuate a drive control member, such as a reverse polarity switch, during rotation of the drive gear. When actuated, the drive control member reverses the drive to the motor and thereby reverses the drive to the fish-finder. A display panel contains diode indicators which are illuminated in response to the movement of the fish-finder.

18 Claims, 3 Drawing Sheets

REVERSIBLE FISH FINDER APPARATUS

BACKGROUND AND SUMMARY OF THE PRESENT INVENTION

The present invention relates generally to fish finding devices and more particularly to a reversible drive apparatus which rotates the fish finder transducer back and forth in a preselected pattern in a generally horizontal orientation.

Fish finders have been widely used in the past for providing a fisherman with a means of determining both the depth of the water and for locating either single fish, or schools of fish. Such fish finders have incorporated various echo ranging devices which emit a sound from a submerged transducer downwardly from the boat. When the sound beam strikes a fish or the water bottom, it reflects an "echo" back to the transducer. The echo is converted to electrical energy which may then be amplified and displayed on a video screen.

Typically, fish finders are fixed to a mounting member attached to the boat so that the echo ranging device is directed either downwardly or sideways from the boat. The fish finder can only be rotated in this position by the fisherman manually moving the mounting assembly to perform a "sweep" of a given area.

Recently, side-scan fish sonars have entered the market. A side-scan fish sonar is one wherein the transducer or echo ranger is mounted in a manner so that it faces sideways to "see" a plane of water which is somewhat parallel to the plane of the boat. It permits echo sounding in a generally horizontal orientation. An example of such a side-scan fish sonar is the Scout® Side Finder fish finder manufactured by the Bottom Line Corporation. These side-scan fish finders are typically mounted on the exterior of a propeller housing of a trolling motor. The trolling motor can be manually pivoted by the fisherman by way of a handle, which pivoting causes the fish finder to rotate in a horizontal plane. In order to effectively scan the water ahead of or to the side of the boat, the fisherman must devote time and substantial effort to this scanning motion, thereby decreasing the time spent actually fishing. Thus, a need for an apparatus which moves the transducer in a scanning movement exists.

There have been some attempts to solve the aforementioned problems. U.S. Pat. No. 2,825,884, issued Mar. 4, 1958 describes an echo ranging device in which a sound transducer is mounted in a submersible housing. A gear shaft extends beneath a boat mounting bracket into the housing and drives the transducer by way of a bevel gear drive in a U-shaped movement. A motor causes this reciprocating action by way of a specially configured gearcam arrangement. The bevel gears are mounted in the housing in a manner which does not permit the mechanism to operate sideways. It is also limited in its variability of rotations. Accordingly, the total area read by the sonar transducer is quite small.

Another device for a searching sonar is described in U.S. Pat. No. 4,815,048, issued Mar. 21, 1989, which describes a dual axis transducer assembly in which a sonar transducer is tiltable about a horizontal axis and which can be driven in rotation around a vertical axis. This construction is overly complicated and expensive because it requires two motors to separately drive the transducer around each of the horizontal and vertical axes. Similar to the device mentioned in U.S. Pat. No. 2,825,884, no provision is made for adjusting the rotation of the transducer.

The present invention overcomes the aforementioned disadvantages. The present invention is directed to a selective reversible drive assembly which rotates a side-scan sonar transducer or similar echo-ranging device back and forth automatically in an arc which is chosen by the fisherman. The drive supplied to the sonar transducer is continuous and is driven by a motor, and the drive of the motor is reversed when the sonar transducer reaches the end of the chosen arc by the fisherman and the motor is automatically reversed to drive the sonar transducer back in the opposite direction. This automatic reversal feature is accomplished by positioning a motor drive control member such as a reverse polarity switch, relay or magnetic pulse assembly proximate to a drive gear of the same such that when the drive gear rotates, an actuating means associated therewith actuates the drive control member to reverse the direction of the motor. The actuating means can include a mechanical stop, a magnet or other similar member which can engage the drive control member during rotation of the drive gear.

The drive gear drivingly engages a driven gear which turns the sonar transducer while drive is supplied to it by the drive gear. When energized, the motor rotates the drive gear which rotates the driven gear to rotate the sonar transducer. The rotation of the drive gear and the transducer, continues in a first drive direction until the actuating means contacts the motor or drive control member causing the motor to reverse its drive or rotation. The rotation of the sonar transducer is correspondingly reversed until the actuating means again contacts the drive control member in its returning path. When such contact is effected the motor drive is reversed again back to its original direction.

The actuating means may use either one or more actuators. Where only one actuator is used, a full, reversing 360° is obtained and where two actuators are used, the actuators may be spaced apart on the drive gear in a desired angular spacing which corresponds to the angle which the fisherman desires to sweep with the sonar transducer. Accordingly, the present invention provides the fisherman with a variably selective reversing drive mechanism for a sonar transducer or echo-ranging device.

In another aspect of the present invention, a visual display is associated with the drive housing and includes a plurality of visual indicators which are activated by the driven gear to visually indicate to the fisherman the area which he is scanning. The visual display may be part of the drive housing or it may be a separate structure therefrom interconnected thereto by suitable means.

Accordingly, it is an object of the present invention to provide a reversible drive apparatus for a side scanning fish sonar in which the transducer is driven back and forth in a general horizontal plane beneath the boat.

It is another object of the present invention to provide a fish finder assembly having a selective reversing drive mechanism in which the fish finder transducer automatically sweeps a preselected amount of a horizontal plane without being manually moved by the fisherman.

It is a further object of the present invention to provide a drive apparatus for a side-scan fish sonar transducer, wherein the drive apparatus rotates the fish sonar in a preselected pattern beneath a fishing boat and wherein the preselected pattern can be easily changed by the fisherman.

It is yet another object of the present invention to provide a selectively reversible drive apparatus for a side-scan fish sonar in which the arc swept by the fish sonar is visually indicated on a display member.

It is still another object of the present invention to provide a selectively reversible drive apparatus for a side-scan fish sonar wherein the drive assembly includes a gear train which is driven by a motor and wherein one of the gears includes a mechanical stop member which actuates a drive control sensor to reverse the sonar transducer drive direction.

It is a still further object of the present invention to provide a reversible drive apparatus for a sidescan fish sonar wherein the drive assembly includes a gear train driven by a motor and wherein one gear of the gear train includes one or more repositionable magnets which actuate a drive control sensor to reverse the sonar transducer drive direction.

These and other objects and advantages of the present invention will be more clearly understood through a consideration of the following detailed description.

BRIEF DESCRIPTION OF THE DRAWINGS

In the case of this detailed description, reference will be frequently made to the attached drawings in which.

DETAILED DESCRIPTION OF THE PREFERRED EMBODIMENTS

Figure 1:
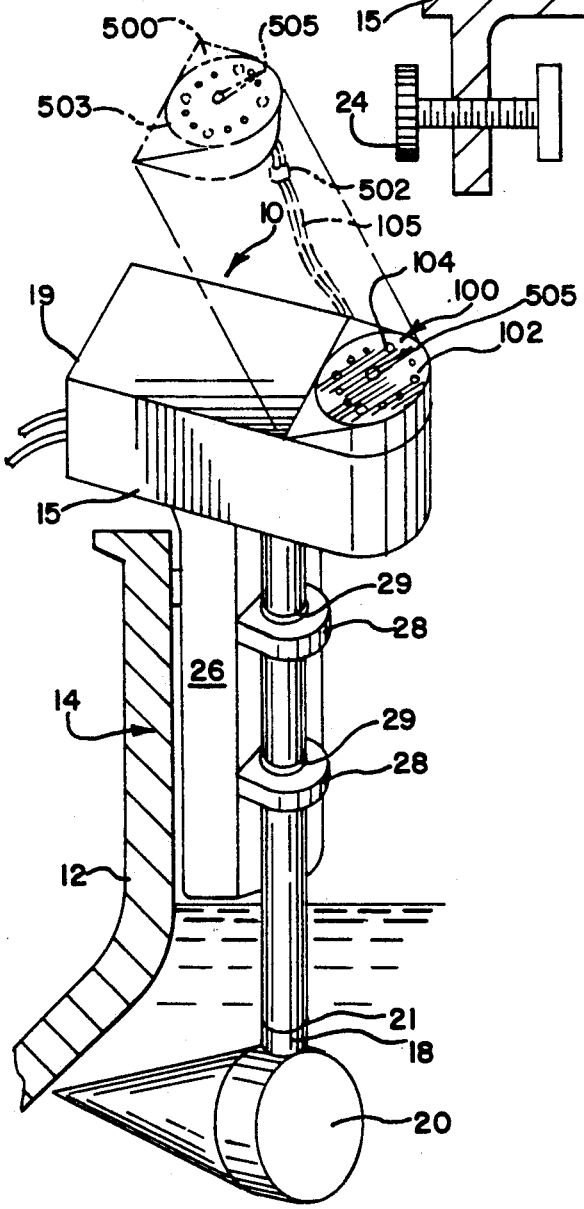
FIG. 1 is a perspective view of a fish finder having a drive assembly constructed in accordance with the principles of the present invention.

FIG. 1 illustrates a fish finding apparatus 10 incorporating a reversible drive assembly 11 constructed in accordance with the principles of the present invention in which the apparatus 10 is mounted on a portion 12 of a boat 14, such as the side, bow or transom. The apparatus 10 generally includes a drive housing 15, a drive shaft 16, and a sonar head 18. The sonar head 18 may be a conventional ring as shown which receives a conventional side-scan sonar transducer head 20 or other similar echo-ranging device therein.

The sonar transducer 20 is mounted on a lower end 21 of the shaft 16. The drive shaft 16 is rotatably mounted in one or more bearings 29 held within a pair of guide arms, or brackets, 28 which project out from a post, or stanchion, 26. The stanchion 26 typically projects downwardly from the housing 15 along the boat 12 and serves to support the entire apparatus 10 in place on the boat. The drive shaft 16 may also be further rotatably held in place by way of a hub 17 which encircles the shaft 16 and which is disposed within the drive housing 15. In instances where the apparatus 10 is portable, the apparatus 10 may include a conventional transom mounting mechanism such as an internal leg having a clamp 24 as illustrated. Alternatively, the apparatus 10 may be constructed so that it is substantially integrally mounted within the boat 12 such that only the sonar head 18 projects into the water.

Drive Assembly

Figure 2:
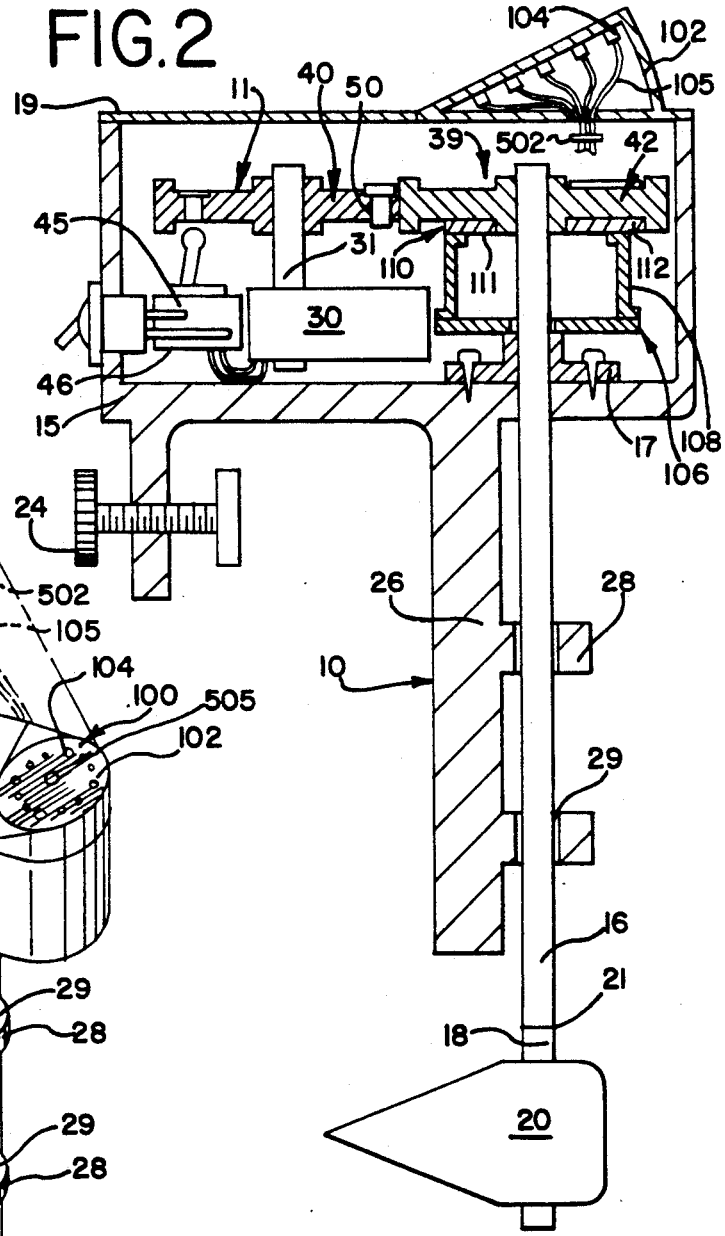
FIG. 2 is a cutaway elevational view of the fish finder apparatus of FIG. 1 taken along lines 2—2 thereof.
Figure 3:
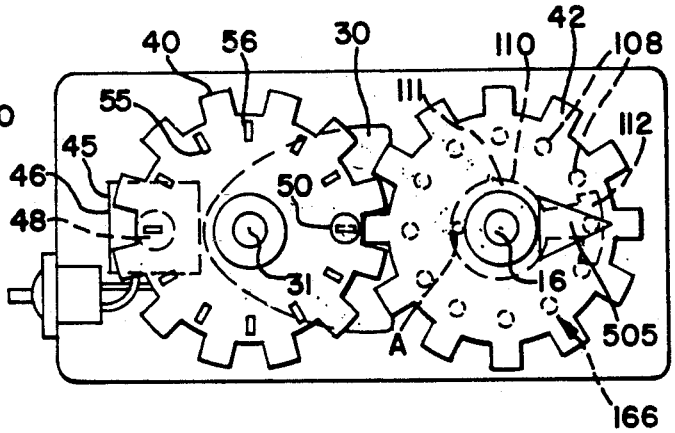
FIG. 3 is a cutaway plan view of the fish finder apparatus of FIG. 1 taken along lines 3—3 thereof.
Figure 5:
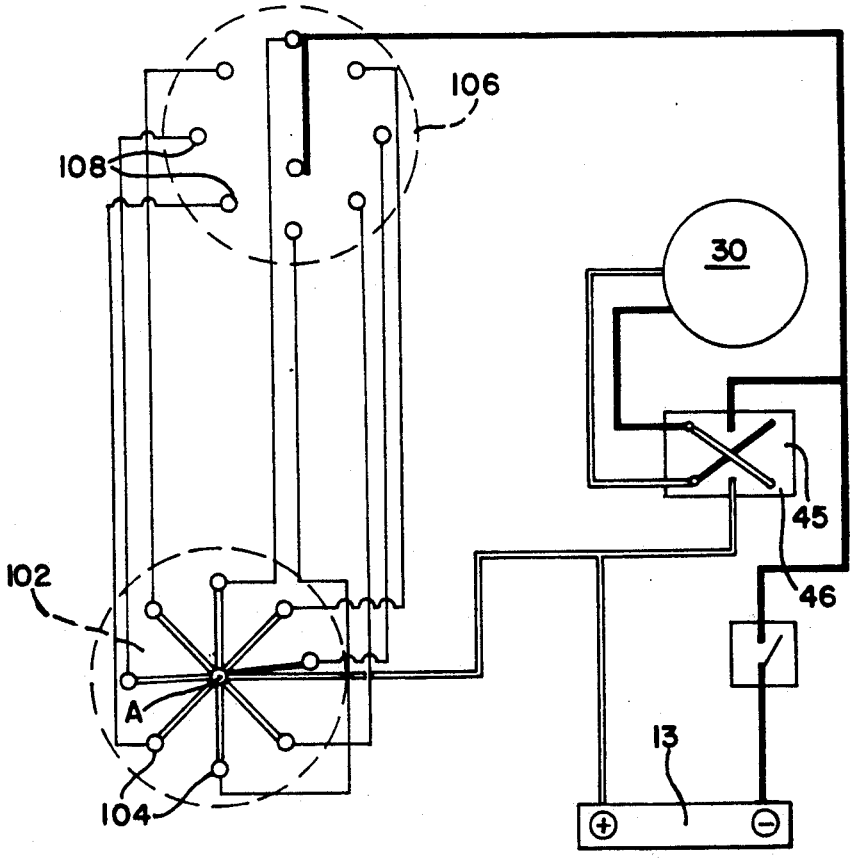
FIG. 5 is a schematic diagram of the fish finder apparatus of FIG. 1.

Turning now to the details of the drive assembly 11, as best shown in FIGS. 2 and 3, a suitable driving means, such as an electrical motor 30, is supported within the drive housing 15. The motor 30 is preferably operated by direct current (DC) from a conventional current source exclusively dedicated to it, such as a portable standard 6-volt or 12-volt storage battery 13, or alternatively, it may be connected to a direct current source built in to the boat as part of the boat electrical and propulsion system. The motor 30 may be of a constant speed motor which revolves at a given rotational speed. As is conventional with DC motors, a central drive shaft 31 extends outwardly from one end thereof.

The drive assembly 11 further includes a gear train 39 which operatively connects the motor 30 to the transducer drive shaft 16. The gear train 39 has at least two interengaged gears 40 and 42. One of the two gears is a drive gear 40 which is connected to the motor drive shaft 31, while the other of two gears is a driven gear 42 which is connected to the transducer drive shaft 16. The two gears 40 and 42 operatively engage each other by way of the intermeshing of their respective gear teeth. Although only two gears are shown in the Figures as constituting the drive train 39 between the motor 30 and the transducer drive shaft 16, it will be understood that the number of gears in the gear train need not be limited in number but may include more than two gears.

By virtue of the operative engagement of the two gears 40 and 42, the rotation of the drive gear 40 by the motor 30 causes a rotation of the driven gear 42, albeit it in a different direction, and thus also causes rotation of the transducer drive shaft 16. As mentioned above, the speed at which the sonar transducer 20 rotates may be constant where the motor 30 is a constant speed type motor. To obtain variable drive speeds of the transducer 20 when a constant speed motor is used, different size and/or toothed gears may be used in the drive train 39. By selectively choosing the gear diameter and number of gear teeth, the operator can modify the assembly so that the transducer drive shaft 16 rotates faster or slower than the rotation of the drive gear 40 and motor shaft 31. Variation in speeds of the drive assembly 11 may be also be obtained by using a variable speed motor and varying the amount of current to the motor 30. The drive housing 15 may be equipped with a suitable cover 19 in order to allow access by the operator to the gear train 39, motor 30, wiring and the like.

Drive Reversing Mechanism

Figure 4:
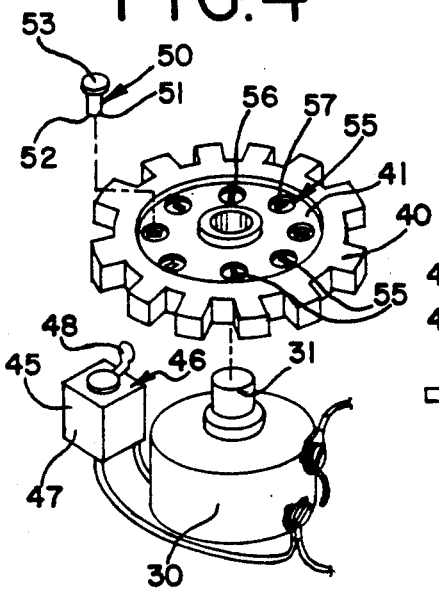
FIG. 4 is an exploded perspective view of the drive gear assembly of the fish finder apparatus of FIG. 1.

In one important aspect of the present invention and as best shown in FIG. 4, a means for reversing the drive of the motor 30, illustrated as a motor drive control member 45 is positioned underneath the body portion 41 of the drive gear 40. The drive gear 40 includes means for actuating the drive control member 45 in the form of one or more elongated stop members, or lugs 50. When actuated, the drive control member 45 reverses the drive of the motor 30.

This reversal is preferably accomplished by reversing the flow of current to the motor 30 and accordingly, as illustrated, may include a reverse polarity switch 46. In the simplest mechanical sense, the reverse polarity switch 46 may include a conventional double-pole, double-throw (DPDT) toggle-style switch 47 having an upwardly projecting toggle 48 which trips the switch by moving between the switch contacts. As is well known in the art, one set of the switch contacts permits the flow of current to the motor 30 in a manner to drive the motor shaft 31 clockwise, while the other set of contacts permits a reverse flow of current to the motor 30 to drive the motor shaft 31 in the reverse direction, or counterclockwise.

Returning to the motor reversal actuating means, it can be seen that each stop 50 has a generally flat base portion 53 and an elongated body portion 51 extending therefrom. The stops 50 are received in any one of a series of slots, or similar openings 55, disposed in the body of the drive gear 40. The actuator slots 55 are generally arranged in the drive gear body 41 according to a preselected angular orientation, in which adjacent slots 55 preferably have an equal angular spacing between them. The slots 55 are preferably configured to securely hold the stop(s) 50 therein, each slot 55 having a rectangular opening 56 which engages the exterior cross-section of the stop body 51. The gear body 41 may also include a recess 57 surrounding each stop opening 56 which supportingly engages the stop base portions 53.

The body portion 51 of a stop 50 extends through and downwardly beneath the drive gear 40. Each slot is preferably oriented on a radius of the drive gear 40 so that a wide, substantially flat face portion 52 of the stop 50 is generally perpendicular to the direction of rotation of the drive gear 40. In this manner, it is assured that the stop face 52 will reliably contact the drive control member toggle 48 as it revolves with the drive gear 40. When the stop 50 contacts the toggle 48 the reverse polarity switch 46 is tripped, thereby causing a reversal of current to the motor 30 consequently causing reversal of rotation of the drive gear 40. When the direction of the drive gear 40 is reversed, the rotation of the driven gear 42 and the transducer drive shaft 16 is also reversed.

Figure 6:
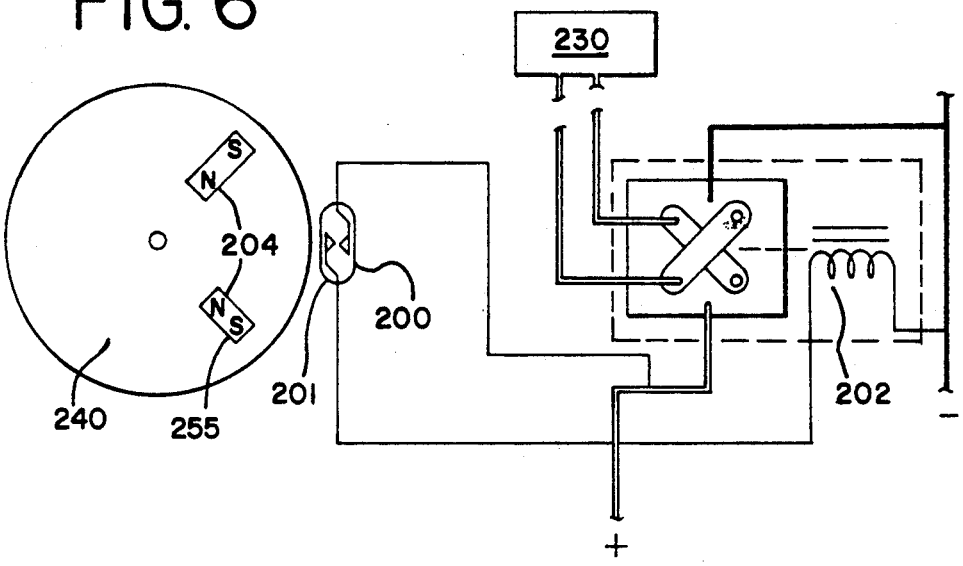
FIG. 6 is a schematic diagram of a second embodiment of a fish finder apparatus constructed in accordance with the principles of the present invention.

In those applications where it is desirable to avoid the use of a mechanically actuated switch for motor reversal, as where quieter operation or improved reliability is desired, the switch function can be accomplished by a magnetically-actuated switch 200 and an impulse-driven DPDT relay 202 as shown in the embodiment illustrated in FIG. 6. The magnetic switch 200, which may be a reed-type switch 201, is actuated by a actuating means in the form of one or more permanent magnets 204 which are mounted on the drive gear 240 in a desired angular spacing. The magnets 204 are repositionable on the drive gear 240 and are received by any one of a series of openings 255 disposed in the drive gear 240. When the magnet 204 passes close to the reed switch 201, the magnetic field therefrom actuates the switch 201. Each actuation of the reed switch 200 applies a current pulse to the relay 202, which then reverses the current to the motor 230 on alternate pulses in a manner well known to the art.

Transducer Sweep Visual Display Means

Another important aspect of the present invention includes a means for visually indicating to the fisherman the path of the sonar transducer 20 rotating underneath the boat. This visual indicating means is shown generally as 100 in FIGS. 1 and 2. As shown in FIGS. 1 and 2, the drive housing cover 19 may be provided with a display panel 102 which may be either located generally above the driven gear 42 in instances where the display panel 102 is incorporated into the drive housing 15 (FIG. 2.) or it may be preferably located remote therefrom such as is shown in FIG. 1 wherein the display panel 500 can be mounted apart therefrom, such as next to the sonar display screen (not shown).

The display panel 102 has a plurality of visual indicators incorporated therein, illustrated as light-emitting diodes (LEDs) 104. The indicator diodes are preferably arranged in a generally circular pattern on the display panel 102. The number of indicator diodes 104 may be equal to the number of stop slots 55 formed in the drive gear 40. Consequently, the visual indicators 104 are preferably positioned within the display panel 102 with an angular spacing equivalent to that between adjacent stop slots 55 of the drive gear 40. Thus, each stop slot 55 has a corresponding indicator 104 disposed at the same angular orientation. Each indicator 104 preferably has a size which permits the operator to easily view the same from a comfortable distance. The indicator diodes 104 may be of different colors to indicate to the fisherman the front or rear of the boat with respect to the transducer movement.

Each indicator diode 104 has a pair of wires, or leads, 105 connected to it. As is conventional in the art for a rotating electrical contact assembly, one lead from each indicator diode 104 is connected to a common terminal which itself is connected to one of the power leads from the battery 13. The other lead of the pair of leads associated with each indicator diode 104 is operatively connected to the driven gear 42 in that it extends from the indicator 104 to a contact pin 108, arranged as part of an overall contact pin assembly 106 positioned proximate to the driven gear 42, illustrated in the Figures as beneath and aligned with the driven gear 42. The contact pin assembly 106 includes a plurality of individual electrical contact pins 108 corresponding in number to the visual indicators 104. A power lead from the battery 13 is connected to a common lead "A" shared by all of the contact pins 108 of the contact pin assembly 106.

As mentioned above, the visual indicating means 100 may be preferably incorporated into a separate, remote housing 500 which is not affixed to the drive housing 15, but may be moved apart therefrom. (FIG. 1) The movability of this remote housing 500 is effected by a wire harness 502 which contains the electrical leads 105 extending between the contact pin assembly 106 and the visual indicators 106. In either occurrence, the visual indicating means may also incorporate a indicator directly responsive to the movement of the driven gear 42 such as an arrow 505, the point of which is aligned with the face of the sonar transducer. The arrow 505 may be mounted directly to the driven gear 42 and thus will indicate the general direction of the transducer to the fisherman utilizing a quick glance.

To illuminate the indicator diodes 104, the driven gear 42 preferably includes means for connecting one or more contact pins 108 with the opposite power lead of the battery 13, in response to and synchronized with the movement of the driven gear 42 by the drive gear 40. This connecting means is illustrated in FIGS. 2 and 3 as a contact bridge 110 having a base portion 111 which is connected to the opposite battery terminal, such as by way of common terminal A, and a generally arcuate blade, or body portion 112. The contact bridge blade 112 is shown positioned radially outwardly from the contact bridge base portion 111 and the axis of the transducer drive shaft 16. The contact blade 112 may have an arcuate extent which is slightly greater than a contact pin 108 for instances where only one indicator diode 104 is desired to be illuminated in response to the transducer movement. Although the contact bridge 110 is illustrated as being in a plane beneath and parallel the driven gear 42, where the contact pins 108 extend upwardly to engage it will be understood that the contact bridge 110 may also extend downwardly and contact pins 108 which may be disposed on the assembly lower member 106. Alternatively, the contact blade 112 may have an arcuate extent which is greater than at least two adjoining contact pins 108 to illuminate more than one indicator diode 104 to indicate to the fisherman the general area being swept by the transducer 20. When the driven gear 42 rotates in response to the rotation of the drive gear 40, the contact bridge 110 rotates coaxially therewith and will bridge the contact pins 108 positioned underneath it which will indicate to the fisherman the path of the sonar transducer 20.

Operation Of The Invention

In operation, the apparatus 10 is connected to the battery 13. The fisherman opens the housing cover 19 and selects the desired pattern of scanning by placing one or more stops 50 in the drive gear slots 55 which define the angular extent of the sweep which the transducer 20 will perform. For example, if the fisherman desires to scan the entire area beneath the boat 14, one stop 50 would be inserted into any desired drive gear slot 55, such as the slot 55 located at the 0° position on the drive gear 40. The 0° position normally corresponds to the front, or bow of the boat 14. When the drive assembly 11 is turned on, current is supplied to the motor 30 (and the visual indicator display panel 102) and the motor shaft 31, and the drive gear 40 attached thereto, begin to rotate clockwise.

Figure 7:
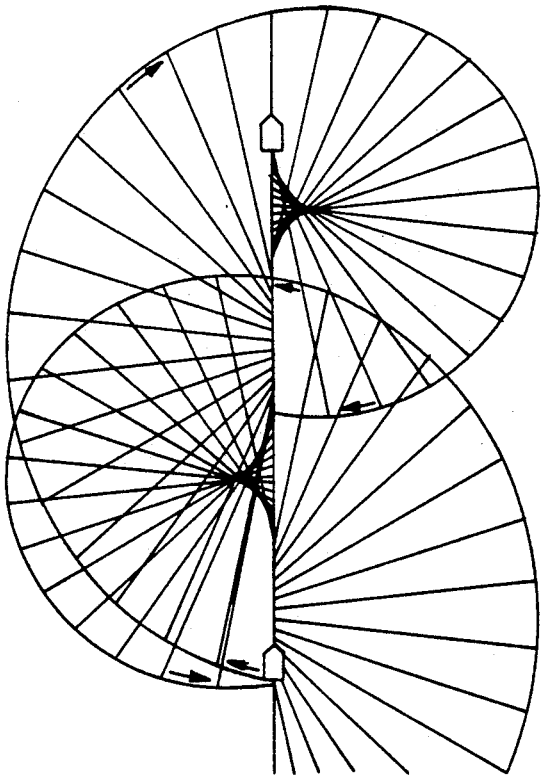
FIG. 7 is a diagram showing the area swept by the present invention in a 360° operating mode.
Figure 8:
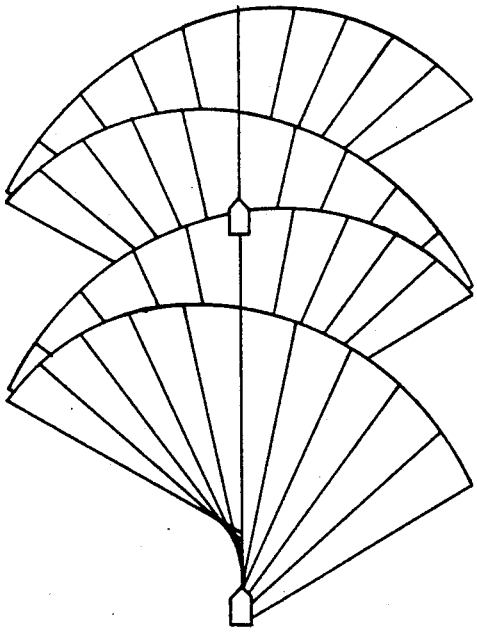
FIG. 8 is a diagram showing the area swept by the present invention in a 120° operating mode.

As the drive gear 40 rotates clockwise, the driven gear 42 and its interconnected transducer drive shaft 16 rotate counterclockwise. This rotation continues until the drive gear stop 50 contacts the reverse polarity switch 46 and trips it. When tripped, the reverse polarity switch 46 reverses the current flow to the motor 30 by switching to a pair of reverse-wired motor leads, thereby causing it to reverse its rotation from clockwise to counterclockwise. The drive gear 40 and its interengaged driven gear 42 then reverse rotation and the transducer 20 begins to sweep in a clockwise direction. When one stop 50 is used, the fisherman is able to scan continuously under the boat in a 360° pattern whether stationary or moving, as shown in FIG. 6.

Where two stops 50 are used, the fisherman can select the desired angular extent of the transducer 20, as shown in FIG. 7. The variety of angular spacings available to the fisherman depends on the number of drive gear slots 55. For example, four such slots would limit the fisherman to sweep patterns of 90° or multiples thereof while twelve drive gear slots 55 would allow the fisherman the choice of angular sweeps of 30° or any multiple thereof.

While the preferred embodiments of the invention have been shown and described, it will be obvious to those skilled in the art that changes and modifications may be made therein without departing from the spirit of the invention, the scope of which is defined by the appended claims.

I claim:

1. A fish finder having a reversible drive assembly for driving a sonar transducer in a preselected pattern, comprising:

a sonar transducer;

means for mounting the transducer to a boat, the mounting means including an elongated mounting member having said transducer mounted therein, said mounting member holding said transducer at a predetermined elevation with respect to the boat, said mounting means further including a housing which rotatably receives said a portion of said mounting member therein;

motor means for supplying rotational drive to said sonar transducer;

a gear train interconnecting the motor means and the transducer, the gear train transmitting rotational drive from said motor means to said transducer, said gear train including at least a drive gear and a driven gear, the drive gear being operatively connected to said motor means in a manner such that said motor means supplies rotational drive to said drive gear, the driven gear being operatively connected to said mounting member, said drive gear and said driven gear operatively engaging each other such that said drive gear supplies rotational drive to said driven gear and said sonar transducer;

means for reversing the drive supplied by said motor means to said gear train whereby rotation of said sonar transducer is reversed; and, means for actuating said drive reversing means, the actuating means being operatively connected to said drive gear.

2. The reversing drive assembly of claim 1, wherein said drive reversing means includes a reverse polarity switch disposed in a path of said actuating means.

3. The reversing drive assembly of claim 1, wherein said driven gear includes dual visual display means associated therewith which displays the rotational position of said transducer.

4. The reversing drive assembly of claim 3, wherein a first of the dual visual display means is contained within said housing and a second of said dual visual display means is contained within a remote housing.

5. The reversing drive assembly of claim 2, wherein said actuating means includes a stop member and said drive gear includes an opening adapted to receive said stop member, said stop member having a body portion which extends through said drive gear opening and extends beneath said drive gear for a predetermined distance, said drive gear having a plurality of stop member openings disposed therein, the stop member openings being further disposed in generally circular pattern with a preselected angular spacing present between adjacent stop member openings, the stop member body portion having a substantially flat face portion adapted to contact said reverse polarity switch.

6. The reversing drive assembly of claim 3, wherein said second visual display means includes a plurality of visual indicators in the form of light-emitting diodes, each of said visual indicators having a contact pin associated therewith and means extending from said visual indicators to a position proximate to said driven gear, said driven gear including means for engaging at least one of said contact pins to cause said visual indicators to be illuminated, said engaging means including a contact bridge which rotates in unison with said driven gear.

7. The reversing drive assembly of claim 3, wherein said first visual display means includes an indicator rotatably connected to said driven gear and said second visual display means includes a plurality of visual indicators in the form of light-emitting diodes, each of said visual indicators having a contact pin associated therewith and means extending from said visual indicators to a position proximate to said driven gear, said driven gear including means for engaging two of said contact pins to cause said visual indicators to be illuminated, said engaging means including a contact bridge having a generally arcuate blade portion which rotates in unison with said driven gear.

8. The reversing drive assembly of claim 1, wherein said drive reversing means includes a magnetically actuated switch and a DPDT relay and said actuating means includes at least one permanent, repositionable magnet and said drive gear includes at least one recess adapted to receive said magnet, said magnet being rotated by rotation of said drive gear by said motor means and said magnetically actuated switch actuating said relay when said magnet is moved proximate to said switch by said drive gear.

9. The reversing drive assembly of claim 8, wherein said magnetically operated switch includes a reed switch.

10. A reversible drive apparatus for a side-scan sonar transducer or the like, comprising, in combination, a housing for attachment to a boat, the housing containing a drive motor, a first gear operatively connected to said drive motor and driven thereby when said drive motor is energized, a second gear operatively connected to a sonar transducer drive shaft, the second gear operatively engaging said first gear, the second gear being driven in rotation by said first gear when said first gear is rotated, means for reversing the drive supplied by said drive motor to said second gear, the drive reversing means including an actuator component repositionably disposed on said first gear and rotatable therewith, a switch component which reverses current supplied to said drive motor to thereby effect reversal of drive of said motor, said switch component being disposed in the path of rotation of said actuator component such that said actuator component contacts said switch component during the rotation of said first gear and trips said switch component to reverse the current supplied to said drive motor and thereby reverse the drive of said drive motor, first gear, second gear and sonar transducer, said reversible drive assembly further including means for visually indicating rotation of said sonar transducer, the visual indicating means being operated by movement of said second gear.

11. The reversible drive assembly of claim 10, wherein said actuator component includes an elongated lug member, and said switch component includes a reverse polarity switch, the switch having a toggle interposed in said rotational path of said actuator component, and said first gear includes a plurality of slots disposed thereon in a preselected angular orientation, each of the slots being adapted to receive said actuator component, said lug member having a generally flat contact face which extends through said first gear slot downwardly from said first gear, the lug member contacting said switch toggle member to actuate said switch.

12. The reversible drive assembly of claim 10, wherein said actuator component includes at least one permanent magnet and said first gear includes at least one recess which receives the magnet therein, and said switch component includes a reed switch which is actuated in response to movement of said magnet near said reed switch.

13. The reversible drive assembly of claim 10, wherein said switch component further includes a DPDT relay operatively connected to said reed switch and said drive motor.

14. The reversible drive assembly of claim 10, wherein said visual indicating means includes a plurality of visual indicators disposed in a generally circular pattern in a display panel, said visual indicators being connected to a contact pin assembly disposed to said second gear, and said second gear having a contact bridge associated therewith which engages one or more contact pins of said contact pin assembly when said second gear is rotated by said first gear.

15. The reversible drive assembly of claim 10, wherein said plurality of visual indicators include a plurality of lightemitting diodes disposed in said display panel, each of said visual indicators including a contact pin associated therewith and disposed in a generally circular pattern and in a preselected angular spacing proximate to said second gear, said second gear including means for bridging said one or more of said contact pins to illuminate said light-emitting diodes, said second gear contact bridge including a generally arcuate contact blade portion.

16. The reversible drive assembly of claim 10, wherein said visual indicating means includes a first and second visual indicating means, the first visual indicating means including a plurality of visual indicators disposed in a generally circular pattern in a display panel, said visual indicators being connected to a contact pin assembly disposed to said second gear, and said second gear having a contact bridge associated therewith which engages one or more contact pins of said contact pin assembly when said second gear is rotated by said first gear, the second visual indicating means including an arrow member rotatably connected to said second gear.

17. The reversible drive assembly of claim 15, wherein said contact bridge arcuate blade has an arcuate length which is greater than the angular spacing between adjacent contact pins.

18. The reversible drive assembly of claim 10, wherein said visual indicating means includes first and second visual indicating means.

* * * * *